US007908098B2

(12) United States Patent
Seki et al.

(10) Patent No.: US 7,908,098 B2
(45) Date of Patent: Mar. 15, 2011

(54) ELECTROCASTING METHOD

(75) Inventors: Kazumasa Seki, Kyoto (JP); Akihiko Hatamura, Kyoto (JP); Hitoshi Yoshida, Kyoto (JP); Toshio Yamashita, Kyoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 12/057,903

(22) Filed: Mar. 28, 2008

(65) Prior Publication Data

US 2008/0237050 A1 Oct. 2, 2008

(30) Foreign Application Priority Data

Mar. 29, 2007 (JP) ..... 2007-088396

(51) Int. Cl.
*G01F 17/00* (2006.01)

(52) U.S. Cl. ..... 702/51

(58) Field of Classification Search ..... 702/51
See application file for complete search history.

(56) References Cited

U.S. PATENT DOCUMENTS 4,053,371 A * 10/1977 Towsley ..... 205/50
4,626,323 A * 12/1986 Trausch ..... 205/127
4,841,618 A * 6/1989 Furuya et al. ..... 29/423

FOREIGN PATENT DOCUMENTS

CN 1658746 A 8/2005
JP 8-225983 A 9/1996

OTHER PUBLICATIONS

English abstract of JP8225983 published Sep. 3, 1996, esp@cenet database, 1 page.
English abstract of Chinese Publication No. 1658746 published on Aug. 24, 2005, 1 page.
Office Action for Chinese Application No. 200810142843X issued on Jan. 8, 2010 and English translation thereof, 10 pages.
Office Action in Chinese Patent Application No. 200810142843.X issued Oct. 25, 2010, with English translation thereof (11 pages).

* cited by examiner

*Primary Examiner* — Aditya Bhat
(74) *Attorney, Agent, or Firm* — Osha • Liang LLP

(57) ABSTRACT

The present invention provides an electrocasting method by which the shape of the surface opposite to the surface to be electrodeposited on the mold can be controlled. A molded metal article is electrocast by forming an insulating layer on the side wall faces of a cavity and the outer wall face of a conductive mold in which the cavity is formed, placing the mold in an electrolysis tank and applying voltage, electrodepositing metal on the bottom face of the cavity, and growing the metal layer in the cavity so as to leave a space having a height of at least one-third the width of the cavity.

5 Claims, 6 Drawing Sheets

ELECTROCASTING METHOD

BACKGROUND OF THE INVENTION

1. Field of the Invention

The present invention relates to an electrocasting method for manufacturing metal parts.

2. Description of the Related Art

Electrocasting is a known technique for forming molded metal articles by plating (electrodepositing) a thin film of metal on a mold. Metal can be electrodeposited just where desired by forming an insulating film on portions of the mold where no electrodeposition is necessary, but some of the current blocked by the insulating film can flow into the electrodeposition portion near the insulating film, and this increases the amount of electrodeposition in some places, which is a problem in that the electrodeposited metal layer has an uneven thickness. Japanese Laid-Open Patent Application H8-225983, for example, discloses that the surface (the side away from the mold) of an electrocast metal layer is polished smooth.

Thus, with conventional electrocasting, it is impossible to control the shape of the surface of a molded metal article (the side away from the side electrodeposited onto the mold).

SUMMARY OF THE INVENTION

In light of the above problem, it is an object of the present invention to provide an electrocasting method with which the shape of the electrocasting can be controlled on the side away from the side electrodeposited onto the mold.

To solve the above problem, the present invention is an electrocasting method comprising the steps of forming an insulating layer on the outer surface of a conductive mold in which a cavity is formed, and on the side wall faces of the cavity, and placing the mold in an electrolysis tank, applying voltage, electrodepositing metal on the bottom face of the cavity, and leaving, in the cavity, a space having a height of at least one-third, and preferably at least two-thirds, the cavity width.

With this method, metal is not electrocast over the entire internal space of the cavity, but rather the growth of the metal layer is halted so as to leave a space of at least one-third, and preferably at least two-thirds, the cavity width, the result of which is that the upper part of the insulating layer formed on the cavity side wall faces blocks current that attempts to flow in at an angle to the metal layer already electrodeposited from the portion of a counter electrode not directly across from the cavity, so there is no variance in the thickness of the electrodeposited metal. Accordingly, the electrocast metal layer grows uniformly, so that there is always a constant distance from the portion where the insulating layer of the mold is not formed.

Also, with the electrocasting method of the present invention, the insulating layer may be formed on at least part of the peripheral edge of the bottom face of the cavity. The metal layer grows so that there is a constant distance from the portion of the mold where no insulating layer is formed, so the metal layer is formed so as to form a curved surface at the upper part of the insulating layer of the outer peripheral part of the bottom face. This allows the edge on the side of the molded metal article away from the mold to be chamfered.

Also, with the electrocasting method of the present invention, the bottom face may be a collection of faces whose angle of inclination is 60° or less with respect to a face perpendicular to the voltage application direction. If a face of the mold where no insulating layer is formed is not inclined more than 60° from a face perpendicular to the direction of voltage application between the counter electrode [and the mold], then this inclined face will draw in current at an angle from the counter electrode, and the metal layer can be prevented from growing unevenly.

Also, with the electrocasting method of the present invention, a stepped portion that expands an opening area of the cavity may be formed on the side wall faces. This allows part of a molded metal article to protrude in a different direction from the voltage application direction.

Also, with the electrocasting method of the present invention, the end point of the electrodeposition may be determined by the sum total of supplied current. The total amount of electrodeposited metal is proportional to the amount of current supplied, so the thickness in which the metal layer is grown can be ascertained without being directly measured.

With the present invention, since the growth of the metal layer is halted so leave a space of at least one-third the width of the cavity, current flows in from the sides of the metal layer, the molded metal layer has a uniform thickness, and there is no need for finishing of the surface away from the mold.

DESCRIPTION OF THE PREFERRED EMBODIMENTS

Embodiments of the present invention will now be described through reference to the drawings.

Figure 1:
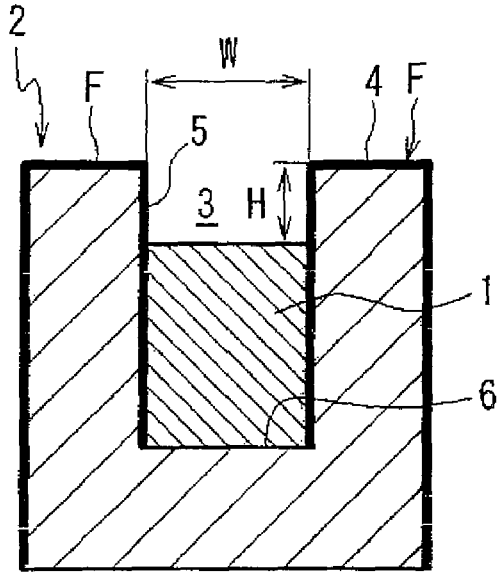
FIG. 1 is a cross section in the width direction of a mold and a molded metal article in an embodiment of the present invention.

FIG. 1 is a cross section of a molded metal article 1 produced by electrocasting and a conductive mold 2 used for this electrocasting. The mold 2 is disposed facing a counter electrode in an electrolysis tank containing electrolyte, and voltage is applied between the mold 2 and the counter electrode. The term electrocasting here refers to a thick-film plating technique in which electrolyzed metal is electrodeposited on the mold 2. The metal layer electrodeposited on the mold 2 by this electrocasting is peeled away from the mold 2 to form a metal part in which the shape of the mold 2 has been inversely transferred.

The mold 2 used in the present invention has formed in it a cavity 3 that serves as an inverted mold for the molded metal article 1, and has an insulating layer F formed on the portion in which the cavity 3 is not formed on the outer surface 4 facing the counter electrode, and on the side wall faces 5 of the cavity 3. The insulating layer F is not, however, formed on the bottom face 6 of the cavity 3.

Figure 2:
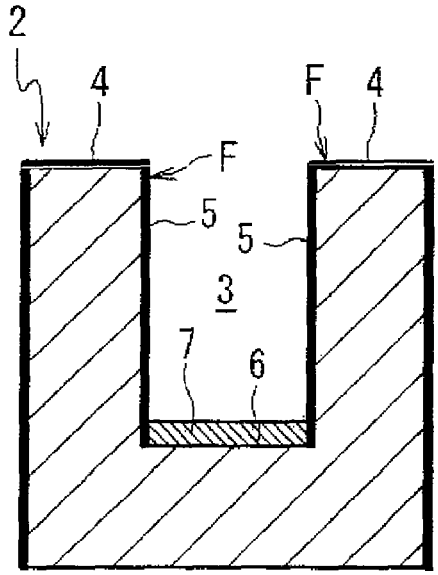
FIG. 2 is a cross section illustrating the process of electrocasting the molded metal article in FIG. 1.

When a new mold 2 is placed in the electrolysis tank and voltage is applied between the mold 2 and the counter electrode, metal ions in the electrolyte are electrodeposited on the surface of the mold, forming a metal layer 7, as shown in FIG. 2. Meanwhile, since the insulating layer F blocks current, no metal is directly electrodeposited on the insulating layer F even though voltage is applied between the mold 2 and the counter electrode. Therefore, the metal layer 7 grows in the voltage application direction from the bottom face 6 inside the cavity 3.

As shown in FIG. 1, with the present invention, the cavity 3 is designed so that when the metal layer 7 is grown to the height of the desired molded metal article 1, a space having a height H of at least one-third the width W of the cavity 3 will be left. That is, with the present invention, the end point at which the growth of the metal layer 7 is halted is determined so as to leave a head space of H≧⅓ W at the upper part of the cavity 3.

Faraday's law tells us that the sum total of current flowing between the mold 2 and the counter electrode is proportional to the total amount of electrodeposited metal, so the end point of electrocasting can be detected by integrating the value of the supplied current.

If the growth of the metal layer 7 is halted so as to leave a head space of H≧⅓ W at the upper part of the cavity 3, the upper part of the insulating layer F formed on the cavity 3 side wall faces 5 will block current that attempts to flow in at an angle from a location facing the outer surface 4 of the counter electrode from the metal layer 7, the current will flow uniformly to the entire metal layer 7, and the metal layer 7 will grow uniformly.

Therefore, the molded metal article 1 produced by the growth of the metal layer 7 will have a shape conforming to the cavity 3, with the face across from the counter electrode away from the mold 2 having a constant distance from the bottom face 6.

Figure 3:
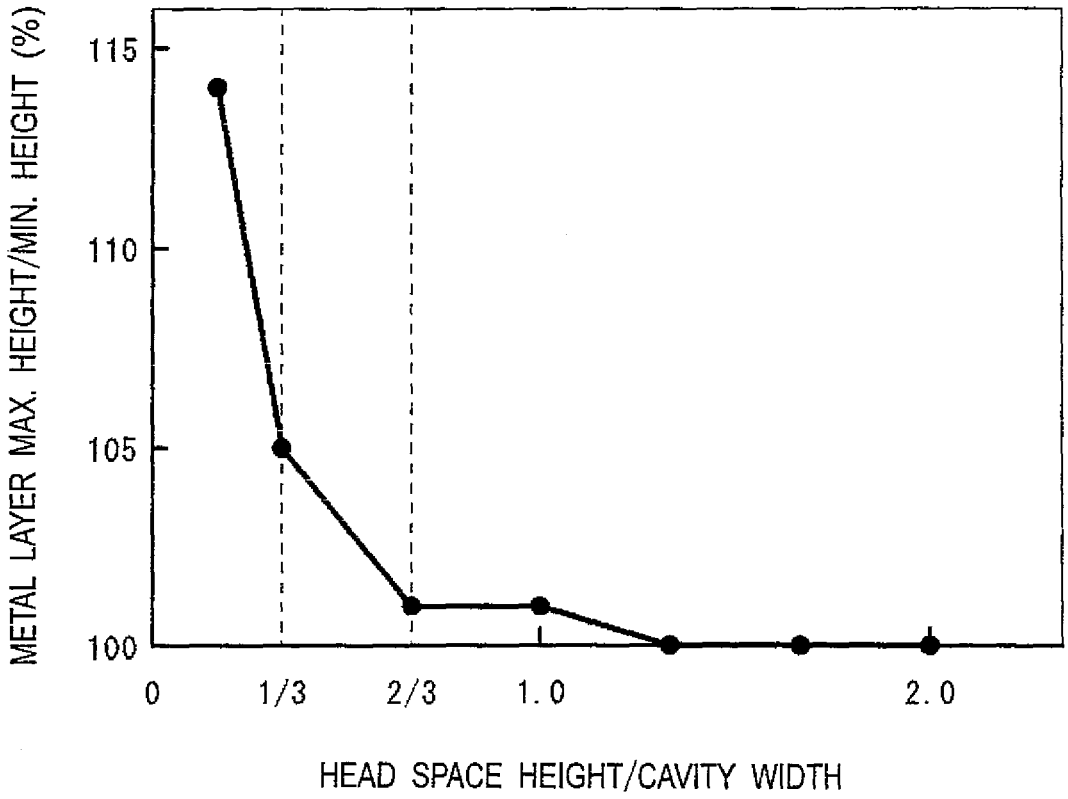
FIG. 3 is a graph of the change in the variance in thickness of the metal layer versus the ratio of the head space height to the cavity width.

FIG. 3 is a graph of the results of confirming how much variance occurs in the thickness of the metal layer 7 of the molded metal article 1 due to the width W of the cavity and the height H of the head space left above the molded metal article 1. Variance in the thickness of the metal layer 7 was evaluated by the ratio between the thickness of the thinnest part of the metal layer 7 (minimum thickness) and the thickness of the thickest part (maximum thickness).

If the head space height H is thus at least one-third the cavity width W, variance in the thickness of the metal layer 7 will be no more than 5%, and for practical purposes will be kept to a level that poses almost no problem. Furthermore, if the head space height H is at least two-thirds cavity width W, variance in the thickness of the metal layer 7 will be no more than 1% and can be kept to a level that can almost be ignored.

Figure 4:
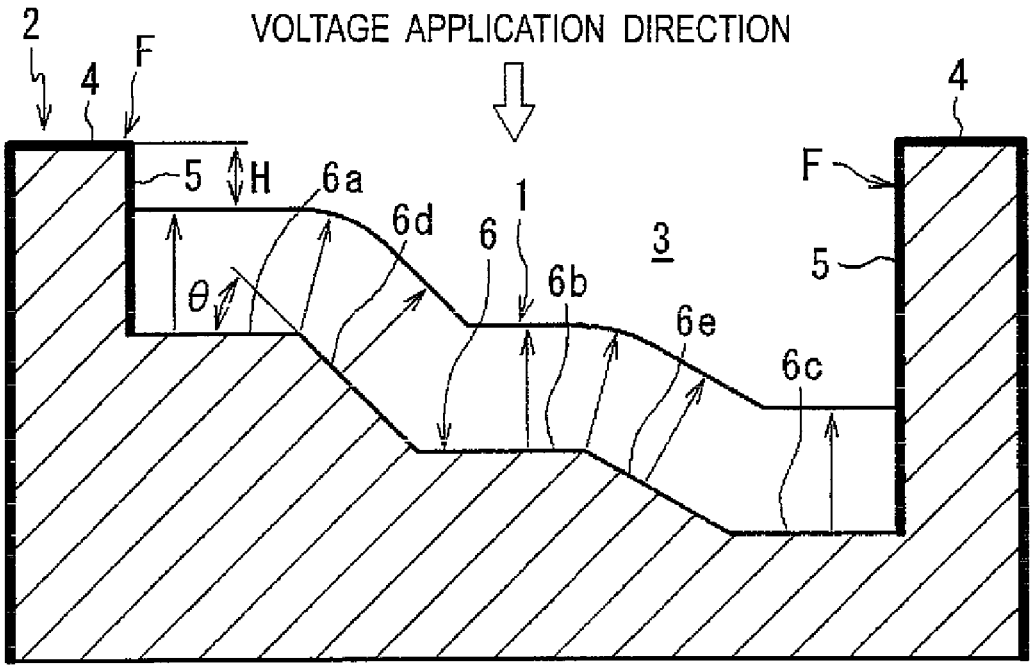
FIG. 4 is a cross section in the length direction of the mold and the molded metal article in FIG. 1.

FIG. 4 is a cross section in the length direction of the molded metal article 1 and the mold 2. As shown in the drawing, the cavity 3 comprises three flat face components 6*a*, 6*b*, and 6*c* at which the depth of the bottom face 6 varies and which are each directly across from the counter electrode (perpendicular to the voltage application direction), and inclined face components 6*d* and 6*e* that connect the flat face components 6*a*, 6*b*, and 6*c* and are inclined to the faces perpendicular to the voltage application direction.

The height H of the head space here is the height of the space left at the thinnest portion of the cavity 3. As shown in FIG. 4, even if the length of the cavity 3 is greater than the height H of the head space, there will be no variance in the thickness of the molded metal article 1 as long as the head space height H is at least one-third the width W of the cavity 3 (its length in the direction in which the transverse direction becomes shorter).

Also, the metal layer 7 is electrodeposited on the flat face components 6*a*, 6*b*, and 6*c* and the inclined face components 6*d* and 6*e* such that it has an equal thickness (such that the distance from the bottom face 6 is constant) with respect to the bottom face 6 having the inclined face components 6*d* and 6*e*. The metal layer 7 is electrodeposited such that its thickness is equal (such that the distance from the bottom face 6 is constant) even in the corners formed by the flat face component 6*a* and the inclined face component 6*d*, and by the flat face component 6*b* and the inclined face component 6*e*.

Figure 5:
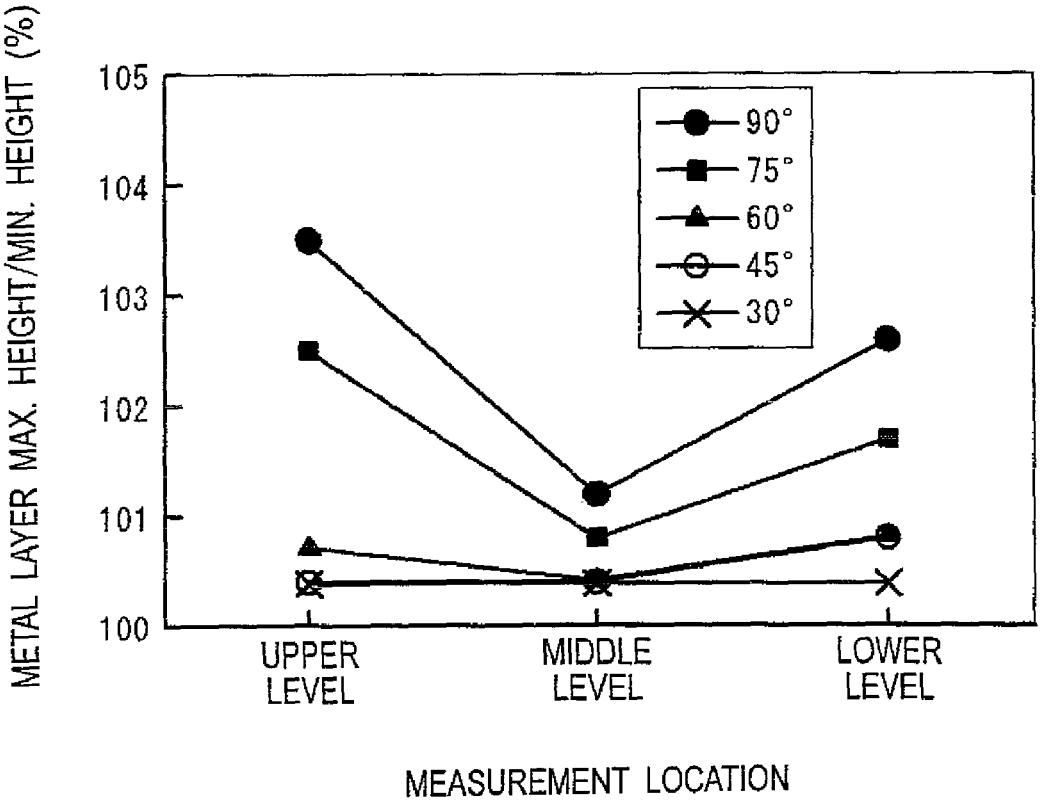
FIG. 5 is a graph of the change in the variance in thickness of the metal layer versus the inclination angle of the inclined face components of the bottom face.

FIG. 5 is a graph of the results of measuring the variance in the thickness of the metal layer 7 at various inclination angles θ of the inclined face components 6*d* and 6*e* (the angle formed with a face perpendicular to the voltage application direction). As shown in the drawing, as long as the inclination angle θ of the inclined face components 6*d* and 6*e* is 60° or less, the variance in the thickness of the metal layer 7 will be 1% or less, which poses no problem at all. If the inclination angle θ of the inclined face components 6*d* and 6*e* is over 60°, however, there will be variance in the thickness of the metal layer 7. This variance in the thickness of the metal layer 7 tends to be greater in the upper flat face component 6*a* and the lower flat face component 6*c* than in the middle flat face component 6*b*.

Thus, with the present invention, the depth of the bottom face 6 is varied such that the inclination angle θ of the inclined face components 6*d* and 6*e* is 60° or less, which allows the shape of the molded metal article 1 to be curved in the voltage application direction while the thickness is kept constant. In other words, the bottom face 6 does not necessarily have to be directly across from the counter electrode.

Figure 6:
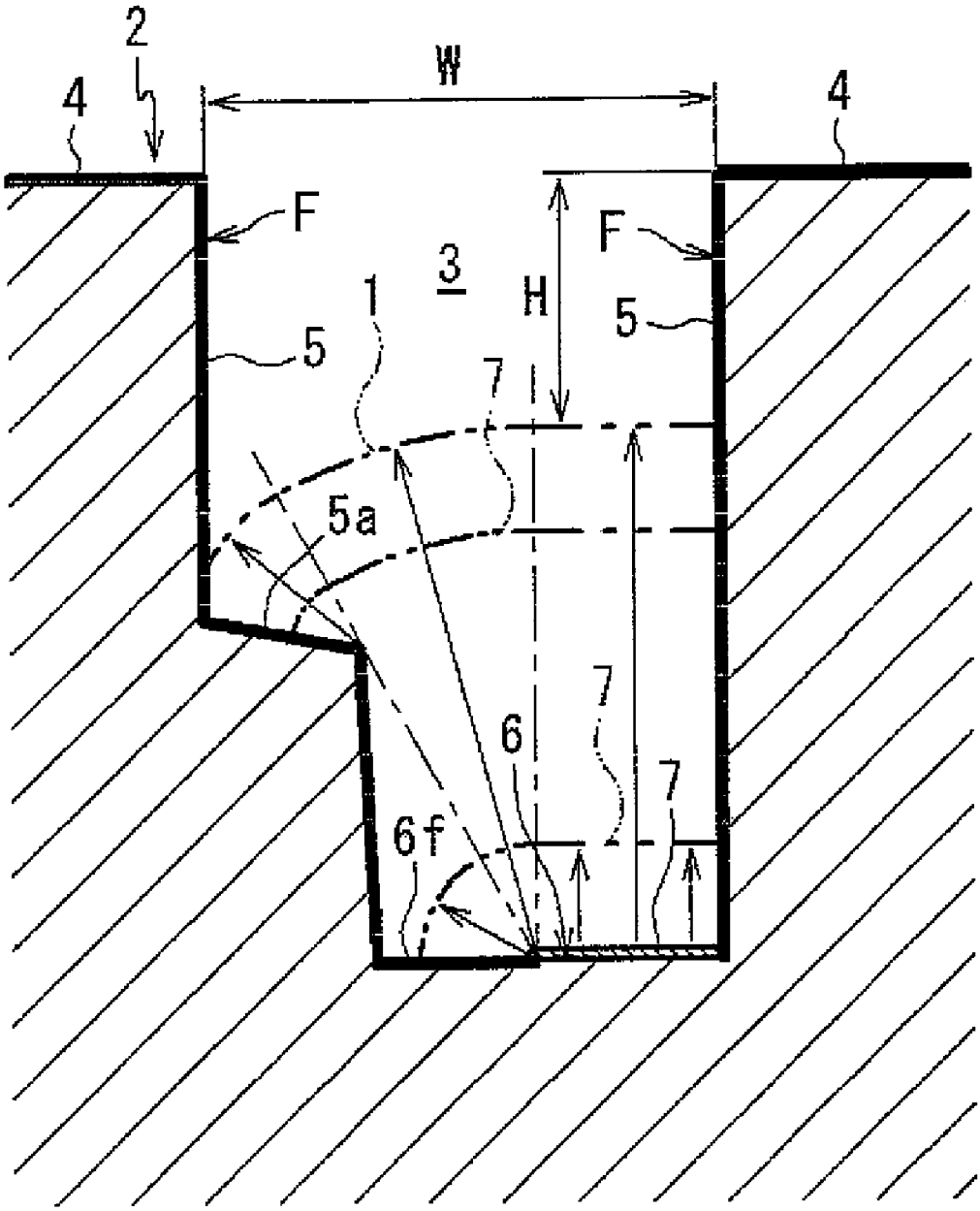
FIG. 6 is a cross section of the cavity in a modification example of the present invention.

FIG. 6 illustrates the growth process of the metal layer 7 and the cavity 3 in a modification of the present invention. This cavity 3 has a stepped component 5*a* formed midway along the side wall face 5, which expands the cross sectional area of the cavity 3 from the middle, and increases the open surface area of the cavity 3 over that of the bottom face 6. Also, the insulating layer F that covers the stepped component 5*a* is extended so as to cover the peripheral edge 6*f* of the bottom face 6.

When this cavity 3 is used for electrocasting, first the metal layer 7 is electrodeposited on the surface of the bottom face 6 that is not covered by the insulating layer F. As the application of voltage is continued, the metal layer 7 grows so as to cover over the insulating layer F covering the peripheral edge 6*f* of the bottom face 6, at a constant distance from the portion of the bottom face 6 not covered by the insulating layer F.

As current flows and the metal layer 7 continues to grow, the growth of the metal layer 7 extends over the stepped component 5*a* as well. Here, the metal layer 7 grows at a constant distance from the edge of the stepped component 5*a* over the portion in the shadow of the stepped component 5*a* as seen from the bottom face 6 not covered by the insulating layer F.

The effect of thus providing the stepped component 5*a* to the cavity 3 is that the molded metal article 1 is cast in a shape extending to the upper part of the stepped component 5*a*. Also, covering the peripheral edge 6*f* of the bottom face 6 with the insulating layer F allows the molded metal article 1 to have a chamfered shape at its upper portion. That is, the use of this modification example allows a metal part to be formed with an R-shaped chamfer added to the surface of a shape obtained by the inverse transfer of the shape of the mold 2.

Figure 7:
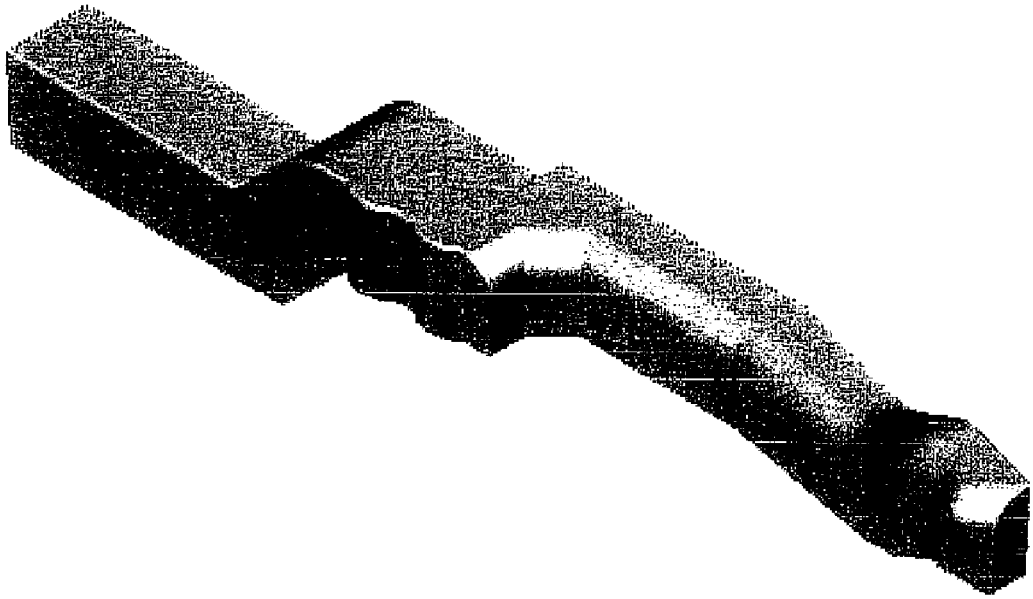
FIG. 7 is an oblique view of a contact member formed by the present invention.

As an example, FIG. 7 illustrates the shape of a contact member for an electronic part, formed by the present invention. With the present invention, a metal part shaped such as this can be formed by electrocasting alone, without any finishing whatsoever being required.

What is claimed is:

1. An electrocasting method, comprising the steps of:

forming an insulating layer on an outer surface of a conductive mold in which a cavity is formed, and on side wall faces of the cavity; and placing the mold in an electrolysis tank, applying voltage, electrodepositing metal on a bottom face of the cavity, and leaving, in the cavity, a space having a height of at least one-third the cavity width.

2. The electrocasting method according to claim 1, wherein the insulating layer is further formed on at least part of the peripheral edge of the bottom face of the cavity.

3. The electrocasting method according to claim 1, wherein the bottom face is a collection of faces whose angle of inclination is 60° or less with respect to a face perpendicular to a voltage application direction.

4. The electrocasting method according to claim 1, wherein a stepped portion that expands an opening area of the cavity is formed on the side wall faces.

5. The electrocasting method according to claim 1, wherein an end point of the electrodeposition is determined by the total sum of supplied current.

* * * * *